US008615886B1

(12) United States Patent
Childers

(10) Patent No.: US 8,615,886 B1
(45) Date of Patent: Dec. 31, 2013

(54) SHAVING SYSTEM WITH ENERGY IMPARTING DEVICE

(76) Inventor: Winthrop D. Childers, San Diego, CA (US)

( * ) Notice: Subject to any disclaimer, the term of this patent is extended or adjusted under 35 U.S.C. 154(b) by 1956 days.

(21) Appl. No.: 11/110,034

(22) Filed: Apr. 18, 2005

Related U.S. Application Data

(60) Provisional application No. 60/568,621, filed on May 6, 2004.

(51) Int. Cl.
*B26B 19/00* (2006.01)
*B26B 19/28* (2006.01)

(52) U.S. Cl.
USPC ..... 30/34.05; 30/44

(58) Field of Classification Search
USPC ..... 30/34.05, 42, 44–46; 327/528
See application file for complete search history.

(56) References Cited

U.S. PATENT DOCUMENTS

| | | | | |
|---|---|---|---|---|
| 4,719,698 | A * | 1/1988 | Ninomiya et al. | 30/43.6 |
| 4,744,144 | A | 5/1988 | Lowery | |
| 4,835,453 | A * | 5/1989 | Munning Schmidt et al. | 320/128 |
| 4,914,816 | A | 4/1990 | Fenn | |
| 5,007,169 | A | 4/1991 | Motta | |
| 5,046,249 | A | 9/1991 | Kawara | |
| 5,065,515 | A * | 11/1991 | Iderosa | 30/140 |
| 5,214,851 | A | 6/1993 | Althaus | |
| 5,299,354 | A | 4/1994 | Metcalf | |
| 5,394,777 | A | 3/1995 | Kozikowski | |
| 5,471,016 | A * | 11/1995 | Krainer et al. | 174/254 |
| 5,653,025 | A | 8/1997 | Cheng | |
| 5,794,342 | A * | 8/1998 | Davey | 30/45 |
| 6,105,252 | A | 8/2000 | Andis | |
| 6,131,288 | A * | 10/2000 | Westerhof et al. | 30/41 |
| 6,421,918 | B1 | 7/2002 | Dato | |
| 6,481,104 | B1 * | 11/2002 | Parker et al. | 30/45 |
| 6,817,101 | B1 | 11/2004 | Bohmer | |
| 6,836,966 | B2 | 1/2005 | Patrick | |
| 6,979,936 | B1 * | 12/2005 | Ganor et al. | 310/328 |
| 7,251,894 | B2 * | 8/2007 | Zuidervaart et al. | 30/45 |
| 2003/0085621 | A1 * | 5/2003 | Potega | 307/18 |
| 2003/0154832 | A1 | 8/2003 | Guimont | |
| 2004/0029313 | A1 * | 2/2004 | Hilscher et al. | 438/106 |
| 2004/0172831 | A1 | 9/2004 | Paas | |
| 2005/0144784 | A1 * | 7/2005 | Ibuki et al. | 30/41 |
| 2005/0172493 | A1 * | 8/2005 | Fischer et al. | 30/45 |
| 2006/0032054 | A1 * | 2/2006 | Simms et al. | 30/34.05 |
| 2006/0279896 | A1 * | 12/2006 | Bruwer | 361/179 |

FOREIGN PATENT DOCUMENTS

| | | | | |
|---|---|---|---|---|
| EP | 1512502 | A1 * | 3/2005 | B26B 19/28 |
| WO | WO 03106118 | A1 * | 12/2003 | |

* cited by examiner

*Primary Examiner* — Ghassem Alie
*Assistant Examiner* — Bharat C Patel
(74) *Attorney, Agent, or Firm* — Dicke, Billig & Czaja, PLLC

(57) ABSTRACT

A shaving implement includes a blade assembly configured for a wet shaving process wherein a user of the shaving implement grips a handle and draws the blade assembly across a surface of skin to be shaved. The shaving implement also includes an energy-imparting device, circuitry, and an activation device. The energy-imparting device is configured to impart energy to enhance the wet shaving process. The activation device is configured to impart a signal to the circuitry in response to handling of the shaving implement during the wet shaving process. In response to receiving the signal, the circuitry either extends or initiates an application of signals to the energy-imparting device that enable the energy-imparting device to impart energy that enhances the wet shaving process.

15 Claims, 9 Drawing Sheets

SHAVING SYSTEM WITH ENERGY IMPARTING DEVICE

RELATED APPLICATIONS

This non-provisional patent application claims priority to U.S. Provisional Application Ser. No. 60/568,621, Entitled "Shaving System With Energy Imparting Device" by Winthrop D. Childers, filed on May 6, 2004, incorporated herein by reference under the benefit of U.S.C. 119(e).

FIELD OF THE INVENTION

The present invention relates to a wet shave razor and more particularly to a wet shave razor having a blade with an energy-imparting device such as a motor rotating an eccentric element and/or a heating element utilized to enhance a shaving process.

BACKGROUND OF THE INVENTION

The wet shaving process is used to shear whiskers or other body hair using a sharp blade. "Wet shaving" or "manual wet shaving" systems in the context of the present invention include a razor assembly having a handle portion coupled to a blade assembly. The handle portion is gripped by a person's hand while the blade assembly drawn across a surface of the person's skin to be shaved. The primary cutting motion or action of the blade is the act of pulling, drawing, or passing the blade across a skin surface using the handle. This in contrast to a "dry shaving" system wherein the primary cutting motion of the blade is a motorized action of the blade against a "micro-screen" that shears off the hairs that pass into the micro-screen. Generally speaking, wet shaving systems are considered to provide close and comfortable shaving results.

Even wet shaving with the sharpest blade can have some irritation and discomfort due in part to the friction between the blade assembly and the skin surface being shaved as well as the tendency of the blade to partially pull on hairs being cut. Also, even the closest shaving process typically leaves behind very short portions of hairs or whiskers. There is an ever-present motivation to improve comfort and closeness of the shaving process.

DETAILED DESCRIPTION OF THE ILLUSTRATED EMBODIMENTS

Figure 1A:
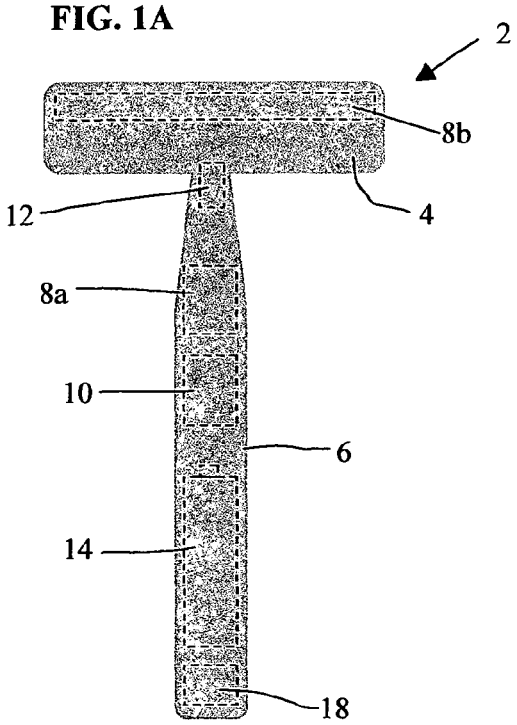
FIGS. 1A and 1B are schematic depictions of the razor assembly or shaving system of the present invention.

The present invention is a "wet shaving system" or a "manual wet shaving system" that optimizes comfort and closeness of the wet shaving process via an electronically activated energy-imparting device that enhances shaving. In a preferred embodiment, the energy-imparting device is controlled in an automated manner that eliminates any need for user difficulty to achieve an optimized and exemplary shaving result.

In one embodiment of the invention, operation of the energy-imparting device is either initiated or extended by the action of shaving. When the shaving system is not in use, the energy-imparting device is deactivated automatically without the user having to remember to press a switch. However, because the activation or extended operation of the energy-imparting device is affected by shaving, the device will not shut down in the middle of a shaving process. This maximizes user convenience while minimizing un-necessary energy usage.

By way of illustrative embodiment, the shaving system of the present invention includes circuitry that is electrically coupled to the energy-imparting device and an activation device. The circuitry is configured to provide or apply power signals to the energy-imparting device to improve the process of shaving. The process of shaving tends to generate forces, displacements, rotations, and/or accelerations induced by the shaving that affects the activation device.

The activation device responds to the forces, displacements, rotations and/or accelerations by imparting an electrical signal to the circuitry. In response to receiving the electrical signal (imparted by the activation device), the circuitry modifies the application of control signals to the energy-imparting device. Stated another way, the circuitry modifies an operational aspect in response to receiving the electrical signal. As one example of an operational aspect, the circuitry extends the duration of time during which power signals are applied to the energy-imparting device.

In another embodiment of the invention, optimized control signals including duration and power level factors are used in an automated way to maximize effectiveness of the energy-imparting device. By way of illustrative embodiment, the circuitry includes control electronics and an information storage device. The information storage device stores operational information indicative of an operational aspect of the power signals transferred from the control electronics to the energy-imparting device.

One operational aspect is the duration that the power signals are applied to the energy-imparting device. A second operational aspect is the power level of the power signals. A third operational aspect is a power versus time characteristic. The energy-imparting device can include two devices such as a source of oscillations and a heat source. In the event that multiple energy-imparting devices are used, different optimized power level versus time curves are applied to each of these devices.

Pursuant to the context of the present invention, a "wet shaving system" is defined as a system wherein the primary cutting motion of the blades relative to the hairs being cut is derived when a blade assembly is dragged or pulled across the skin surface being shaved. This is in contrast to a conventional electric razor or "dry shaving system" wherein the primary cutting motion of the blades relative to the hairs being cut is derived from a relative motion between motorized blades and a micro-screen. Without motorization, the dry shaving system would effectively lose the ability to provide a shave.

In contrast, the energy-imparting device of the present invention provides oscillations, vibrations, or heat that enhances a cutting operation that would take place without the energy-imparting device being activated. Pursuant to this invention, "enhances" means improving the closeness and/or comfort of a shave that would otherwise take place.

Figure 1B:
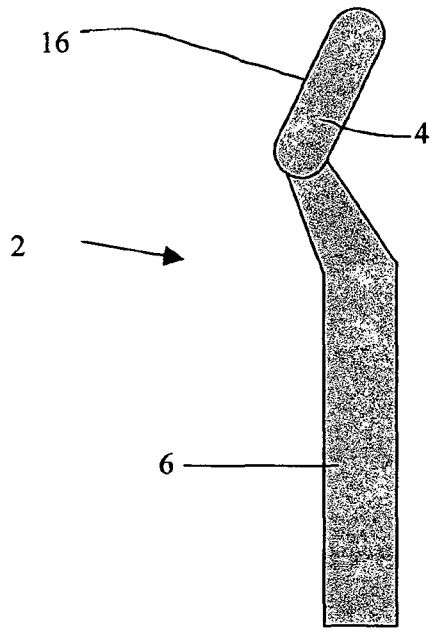
Figure 2:
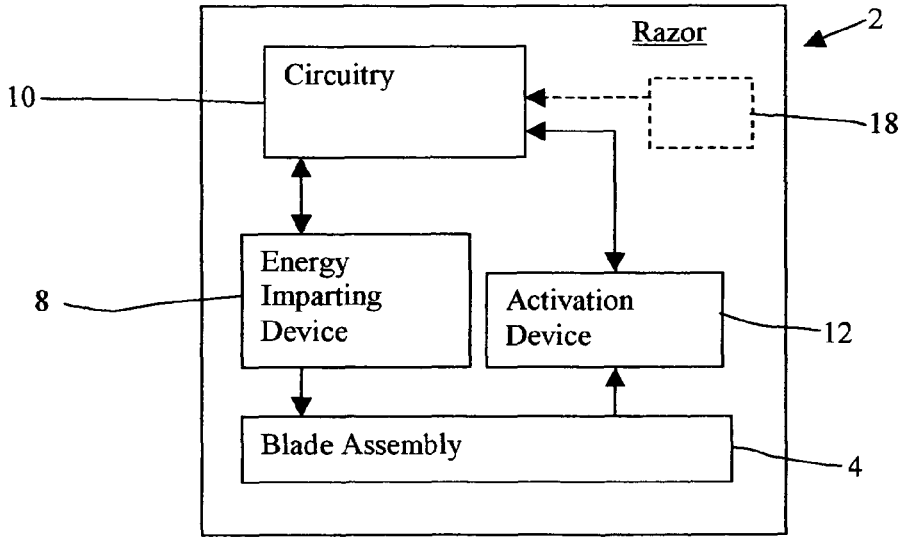
FIG. 2 is a block diagram depiction of the shaving system or razor assembly of the present invention.

A shaving system of the present invention is depicted in FIGS. 1A, 1B, and FIG. 2. FIG. 1A schematically represents a front view, FIG. 1B schematically represents a side view, and FIG. 2 represents a block diagram of the shaving system or razor assembly 2 of the present invention. A razor assembly 2 includes a blade assembly 4 attached to a handle portion 6. The handle portion 6 is held and manipulated while the blade assembly 4 is pressed or urged against a skin surface (not shown) being shaved. The blades (FIGS. 5B and 5C) pass directly over the skin during a shaving process.

The razor assembly 2 further includes an energy-imparting device 8 (meaning 8*a* and/or 8*b*), circuitry 10, an activation device 12, and a power source 14. The circuitry 10 is electrically coupled to the energy-imparting device 8, the activation device 12, and the power source 14. The circuitry 10 is configured to receive power from power source 14, to be activated or affected by activation device 12, and to provide power signals to energy-imparting device 8. In response to receiving the power signals, the energy-imparting device 8 imparts thermal or vibrational energy to the blade assembly 4 that improves the shaving process. The razor assembly 2 is fully functional for shaving without the energy-imparting device 8 but provides an enhanced shave with the energy-imparting device 8.

During a shaving process a force is applied between the blade assembly 4 and the skin surface. In response to this force (or to an acceleration or motion of shaving system 2), the activation device 12 imparts an electrical signal that affects and/or modifies operation of the circuitry 10. Stated another way, the activation device 12 is responsive to the blade assembly 4 being urged and/or passed over the skin surface by activating or sending a signal to the circuitry 10.

In an embodiment of the present invention, the blade assembly 4 is detachable from the handle portion 6. This allows the blade assembly 4 to be replaced without having to discard the handle portion 6 since the handle portion 6 likely contains relatively expensive components such as circuitry 10.

In an embodiment of the present invention, the blade assembly 4 is pivotally mounted on handle portion 6 and spring biased to a "rest" orientation relative to handle portion 6 when razor assembly 2 is not being used. During the shaving process a force of engagement between the facial surface and blade assembly 4 will cause blade assembly 4 to rotate relative to handle portion 6 to allow a cutting surface or face 16 of blade assembly 4 to follow contours of the skin surface.

In an exemplary embodiment power source 14 is a battery such as a AA alkaline battery, a AAA alkaline battery, multiple batteries, or a rechargeable battery.

Energy Imparting Device 8:

In a first embodiment the energy-imparting device 8 is a source of oscillations or vibrations 8*a* such as a motor that drives an eccentric weight for generating oscillations that are transferred to the blade assembly 4. In a second embodiment the energy-imparting device 8 is a heating element 8*b* for warming one or more portions of the blade assembly 4. In yet a third embodiment, the energy-imparting device 8 includes both a source of oscillations or vibrations 8*a* and a source of heat 8*b*.

Activation Device 12:

In a first embodiment the activation device 12 is responsive to a displacement or rotation of blade assembly 4 when the shaving process is initiated or continues. By way of illustrative embodiment, the first embodiment of activation device 12 can be an electrical switch that opens and/or closes an electrical circuit when blade assembly 4 rotates relative to handle portion 6. When the switch is closed (or opened), this imparts an electrical signal that affects operation of circuitry 10.

A second embodiment of activation device 12 is responsive to a force being applied between the razor assembly and a skin surface. By way of illustrative embodiment, the second embodiment can be a pressure transducer such as a piezoelectric crystal that responds to a force by generating a voltage that is detected by circuitry 10.

A third embodiment of activation device 12 is an accelerometer that responds to an acceleration of razor assembly 2 when razor assembly 2 is grasped, lifted, or utilized in the shaving process. Yet a fourth embodiment of activation device 12 is a tip sensor that senses a change in orientation of one or more portions of razor assembly 2 when razor assembly 2 is handled in the shaving process.

Circuitry 10:

One embodiment of circuitry 10 is a circuit that is closed by activation device 12. Closing the circuit provides power to the energy-imparting device 8. A second and preferred embodiment of circuitry 10 includes a control circuitry for operating the energy-imparting device. The control circuitry 10 includes a timer function for controlling a time for operating the energy-imparting device 8. In a preferred embodiment, the control circuitry defines a power versus time characteristic for operating the energy-imparting device to be discussed in more detail with respect to FIG. 8.

In an alternative embodiment, the razor assembly includes an added power switch 18 that is used for activating circuitry 10. The power switch 18 may be used to initially activate circuitry 10 such that circuitry 10 provides power signals to the energy-imparting device 8 for an initial time duration. If the activation device 12 imparts a signal during that initial time duration, then the circuitry continues to provide power signals to the energy-imparting device 8 for an extended time duration. If the activation device 12 does not impart a signal during the initial time duration, then the circuitry 10 halts transferring power signals to the energy-imparting device 8 after a preset time.

Figure 3A:
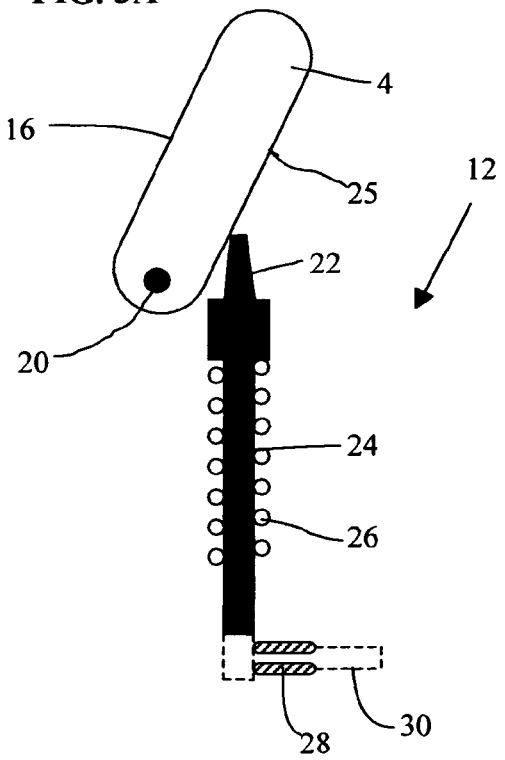
FIGS. 3A and 3B are schematic representations of a first embodiment of the activation device of the present invention.
Figure 3B:
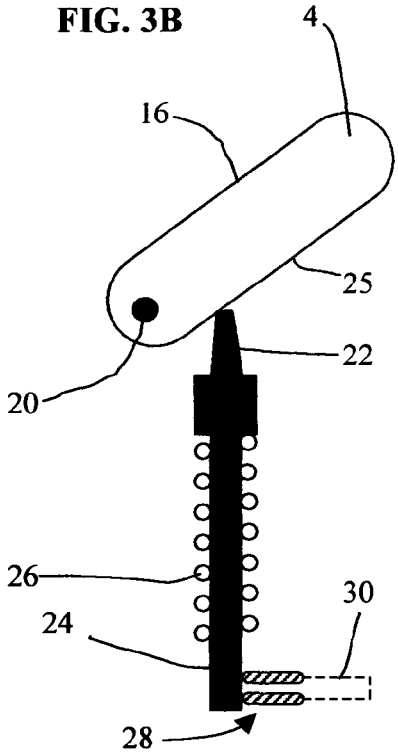

An exemplary embodiment of activation device 12 with many elements of razor assembly 2 missing for illustrative simplicity is depicted in schematic representation in FIGS. 3A and 3B. In the embodiment depicted in FIGS. 3A and 3B, activation device 12 is responsive to a displacement of blade assembly 4 relative to handle portion 6 (not shown in FIGS.

3A and 3B) and more particularly activation device 12 is responsive to a rotational movement of blade assembly 4 relative to handle portion 6.

Blade assembly 4 is pivotally mounted relative to handle portion 6 about pivot 20 to allow rotational motion of the blade assembly 4 relative to the handle portion 6 when the blade assembly 4 engages the skin surface. Prior to shaving, a cam follower 22 rotationally urges blade assembly 4 against a stop (not shown) so that blade assembly 4 is in the rotational position as depicted in FIG. 3A. Cam follower has a cylindrical conductive portion 24 and is urged against a cam surface 25 of blade assembly 4 by spring 26. At this position of cylindrical conductive portion 24, a pair of electrical contacts 28 is not contacted by conductive portion 24.

During a shaving process the cutting surface 16 of blade assembly 4 is pressed against a skin surface, rotating the blade assembly 4 about pivot point 20. The cam 25 surface of blade assembly 4 in turn displaces cam follower 22 and hence displaces conductive portion 24 to contact electrical contacts 28. Electrical contacts 28 are coupled to a circuit 30 that is coupled to or is a portion of circuitry 10. This closes the circuit 30, activating circuit 30. Upon activation circuit 30 imparts an electrical signal to circuitry 10 as discussed before.

Figure 4:
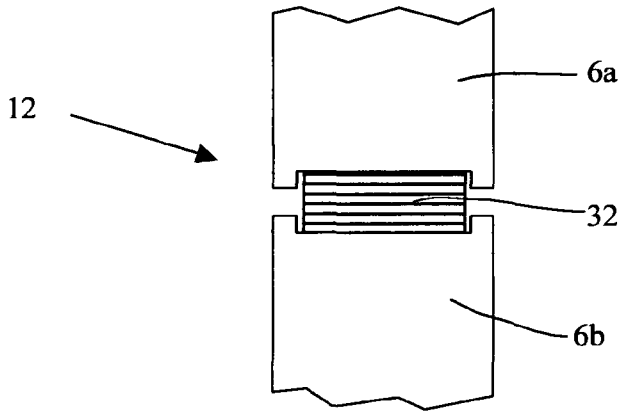
FIG. 4 is a schematic representation of a second embodiment of the activation device of the present invention.

A second embodiment of activation device 12 is depicted in schematic form with respect to FIG. 4. In this embodiment, activation device 12 includes a pressure transducer 32 that is contained within or between portions 6*a* and 6*b* of the handle portion 6. Transducer 32 is electrically coupled to circuitry 10. During a shaving process, a force is translated along handle portion 6 so as to apply a compressive force to transducer 32. In response to the compressive force, transducer 32 imparts an electrical signal to circuitry 10 by providing an electrical impulse such as a voltage pulse to circuitry 10. Stated another way, the transducer 32 is responsive to a force generated when the blade assembly 4 is urged against the skin surface and transducer 32 responds to the force by generating or imparting a signal to circuitry 10.

Various exemplary embodiments of energy-imparting device 8 are depicted in schematic form in FIGS. 5A-D. As depicted schematically in FIG. 2, razor assembly 2 can optionally include more than one energy-imparting device 8 such as a source of vibrations or oscillations 8*a* or a heat source 8*b*. By way of illustrative embodiment, source of oscillations or vibrations 8*a* may include a motor 34 driving an eccentric weight 36 that generates oscillations along an axis A that tends to be parallel to blades 38.

By way of illustrative embodiment, the heat source 8*b* may include one or more heating elements 40 that tend to be disposed to dissipate heat along axes A and A' that tend to be parallel to the blades 38.

Figure 5A:
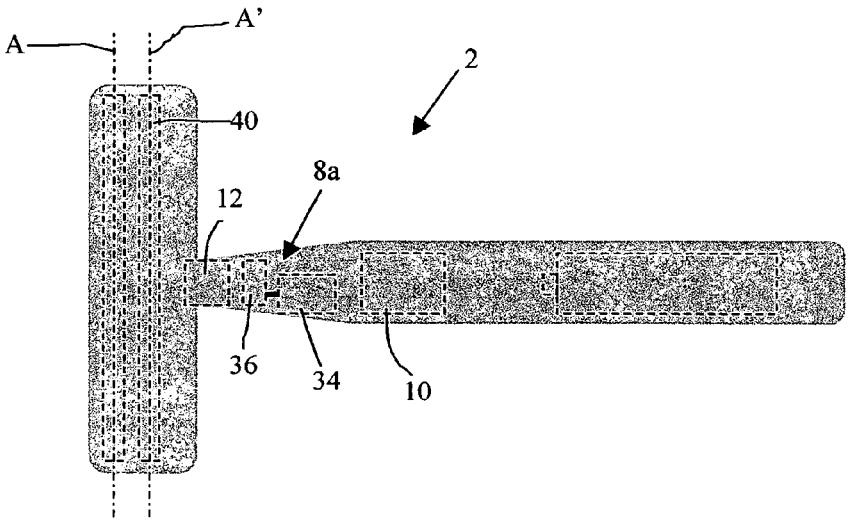
FIG. 5A is a schematic representation of the razor assembly of the present invention.
Figure 5B:
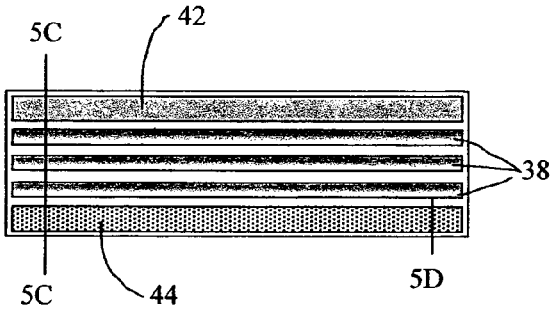
FIG. 5B is a schematic representation of a cutting surface or face of a blade assembly.

FIG. 5B depicts a view of the cutting surface or face 16 of blade assembly 4. By way of illustrative embodiment, blade assembly 4 includes blades 38, lubricating strip or cap 42, and guard 44. Heating elements 40 may be disposed in thermal contact with a portion or with portions of blade assembly 4, including blades 38, lubricating strip or cap 42, and/or guard 44. In one embodiment, there may be a heating element 40 integrated into one or more of blades 38. In a second embodiment, there may be a heating element 40 integrated into lubricating strip or cap 42. In a third embodiment, there may be a heating element 40 integrated into guard 44.

Figure 5D:
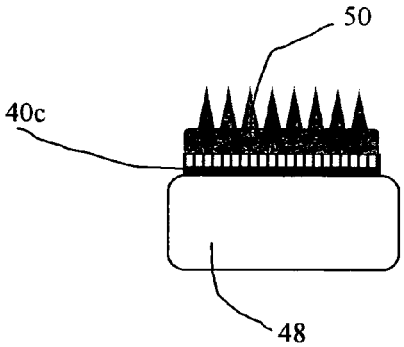
FIG. 5D is a cross sectional schematic representation of a guard taken through taken through 5D of FIG. 5B.
Figure 5C:
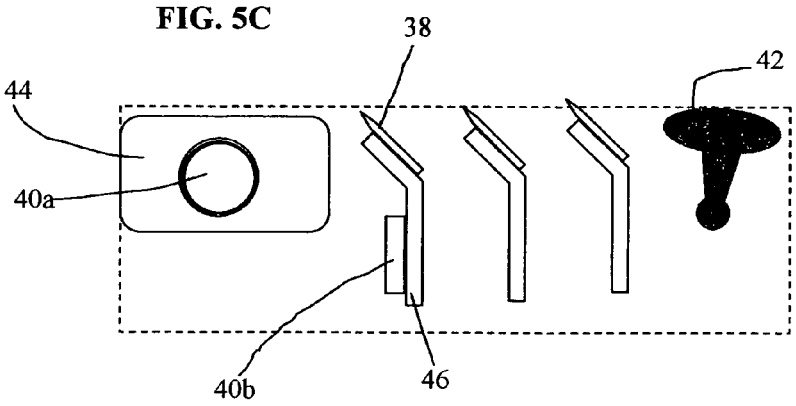
FIG. 5C is a cross sectional schematic representation of the blade assembly taken through 5C-5C from FIG. 5B.

FIG. 5C depicts a cross sectional view of one embodiment of blade assembly 4 with details left out for simplicity. Shown in cross sectional form are blades 38, lubricating strip 42, and guard 44. Supporting blades 38 are blade supports 46. By way of illustrative embodiment, blades 38 are spot-welded to blade supports 46. By way of a first illustrative embodiment, heating element 40 is an electrically insulated nichrome wire 40*a* passing through guard 44. As the blade assembly 4 passes over the skin surface, current passes through the nichrome wire, warming the guard 44 and hence the skin surface.

By way of a second additional illustrative embodiment, heating element(s) 40 is/are a surface heater(s) 40*b* bonded to one or more blade supports 46. During a shaving process, the blades 38 are warmed, which facilitates cutting hairs with less friction.

FIG. 5D depicts a cross sectional view of another embodiment of guard 44. In this embodiment, guard 44 includes underlying support 48 and elastomeric fin structure 50 for enhancing the shaving process. Between support 48 and fin structure 50 is a surface heater 40*c* that functions similarly to the surface heaters discussed earlier.

In yet another embodiment (not shown), a heating element can be applied to cap or lubricating strip 42. The heating element would function similarly to a heating element associated with guard 44.

Figure 6:
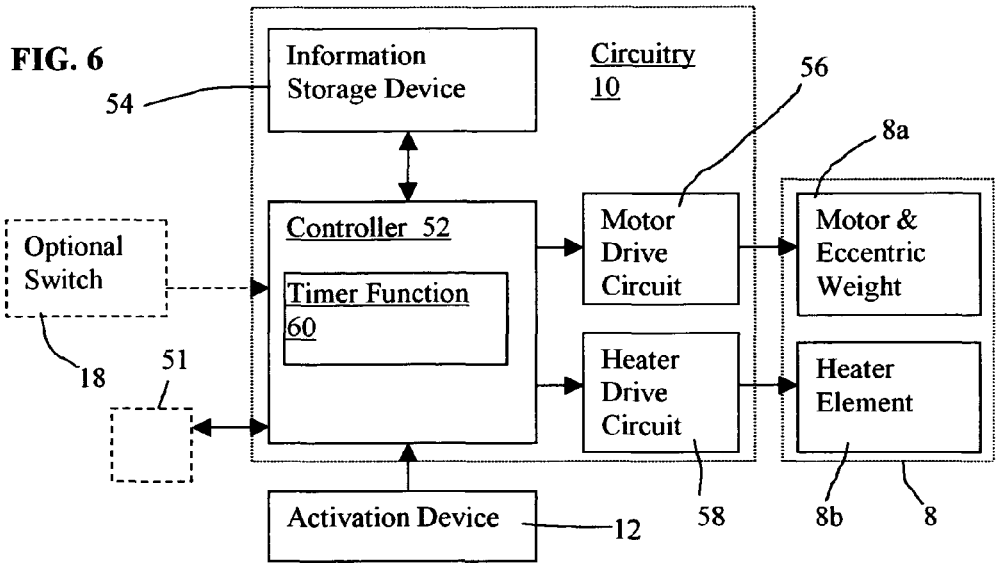
FIG. 6 is a block diagram depiction of a preferred embodiment of the shaving system of the present invention.

The block diagram in FIG. 6 depicts an exemplary embodiment of shaving system 2 to illustrate more embodiments of the invention. Shaving system 2 includes circuitry 10 coupled to energy-imparting device 8, activation device 12, and optionally switch 18 and/or communication device 51. The embodiment depicted in FIG. 6 depicts one particular embodiment for circuitry 10 and energy-imparting device 8 although other embodiments are possible.

Circuitry 10 includes controller 52 coupled to information storage device 54, motor drive circuit 56, and heater drive circuit 58. Controller 52 includes a timer function 60 for controlling a time duration during which power signals are transferred from circuitry 10 to energy-imparting device 8. By way of illustrative embodiment, information storage device 54 includes a non-volatile memory device such as an EEPROM (electrically erasable programmable read-only memory) and/or a PROM (programmable read-only memory). Other possible information storage devices 54 include fusible links or other means of storing information. Energy-imparting device 8 includes the source of oscillations or vibrations 8*a* (motor and eccentric weight as one example) and/or the source of heat 8*b* (heater element).

Initial activation of circuitry 10 can be induced or activated by optional switch 18, activation device 12, and/or a combination of activation device 12 and optional switch 18. Upon activation of circuitry 10, controller 52 reads information from information storage device 54 that is indicative of operating parameters or operational information pertaining to power signals that are transferred from circuitry 10 to energy-imparting device 8.

By way of illustrative embodiments, the operational information or operating parameters may include power level information, time duration information, or power level versus time information pertaining to power signals transferred to energy-imparting device 8. Power level information may include information indicative of a power level for power signals transferred from circuitry 10 to energy-imparting device 8. Time duration information may be indicative of a time duration during which power signals are transferred from circuitry 10 to energy-imparting device 8. Power level versus time information may be indicative of a time variance of the power transferred from circuitry 10 to energy-imparting device 8. Further discussion as to how this information may be used will be discussed with respect to FIG. 8.

The information storage device may also receive and store information during use of the shaving system 2, such as frequency of use, number of shaving strokes detected or inferred per use, and other factors that are useful for marketing efforts attempting to understand use factors for shaving system 2. Communication device 51 may be an audible device and/or a display device such as an LCD (liquid crystal display) for communicating status information to the user of the shaving system 2 such as power remaining in power source 14.

Figure 7:
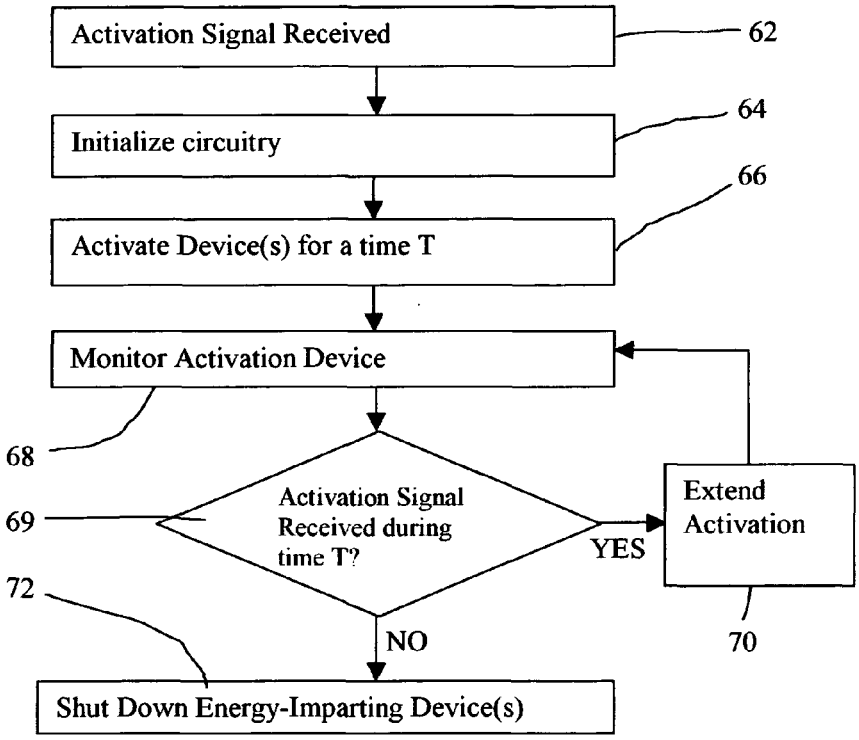
FIG. 7 is an operational flow chart representation for the shaving system.

An exemplary embodiment of the operation of the shaving system of the present invention is depicted in flow chart form with respect to FIG. 7. Initially, according to step 62, an activation signal is received. This may be induced by the user activating power switch 18 or by the user triggering activation device 12.

When the activation signal is received, circuitry 10 is initialized according to step 64. This may include closing a circuit to provide power to energy imparting device 8. In the embodiment depicted with respect to FIG. 6, step 64 also includes controller 52 reading information from information storage device 54.

Next according to step 66, the energy-imparting device 8 is energized or activated for a time duration T. During this time duration, the shaving process is evidently occurring. During shaving, the activation device 12 is monitored according to 68. If the activation device 12 imparts a signal during the time duration T, the time duration for operating the energy-imparting device 8 is extended according to 70. In that event monitoring device 12 continues. However, if no activation signal is received by circuitry 10 for a time period T, then circuitry 10 deactivates energy-imparting device 8 by ceasing to transfer power signals to energy-imparting device 8 according to 72.

Thus, the energy-imparting device remains on when the razor assembly 2 is in use but automatically is de-activated when the razor assembly is not in use. This assures that the energy-imparting device will be utilized when it is needed but saves power when the razor assembly is not utilized.

Figure 8:
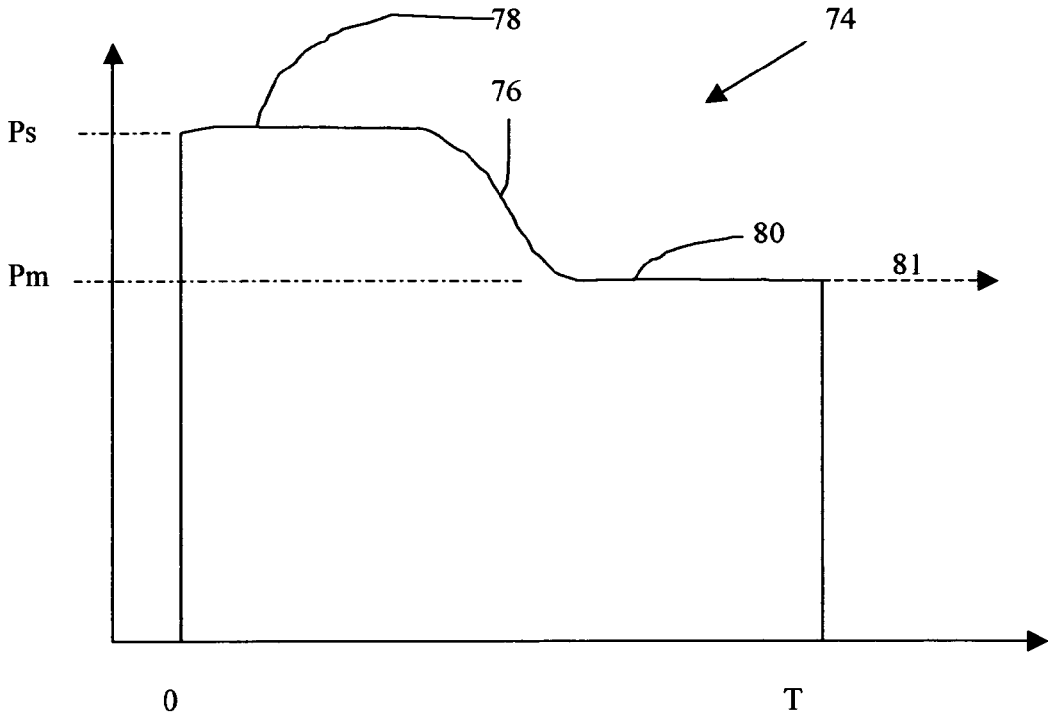
FIG. 8 is a graphical representation of the power versus time to be delivered to the energy-imparting device.

An exemplary operating power curve 74 applied to energy-imparting device 8 is depicted in FIG. 8. This curve may apply to either embodiment 8*a* or 8*b* of the energy-imparting device.

Referring now to FIG. 6, information storage device 54 stores information indicative of the curve 74. Stated another way, information storage device 54 stores information indicative of parameters that define curve 74, which depicts the functional relationship of power versus time applied to energy-imparting device 8. By way of illustrative embodiment, these parameters include an initial startup power level Ps, a maintenance power level Pm, an overall time duration T, and other information indicative of a transition 76 between a higher power portion 78 of curve 74 and a lower power portion 80 of curve 74.

During initialization of electronics 10 (according to step 64 of FIG. 7) an initially high or startup power level Ps is applied to the energy-imparting device 8. For example, in the event that energy imparting device 8 is a heater 8*b*, the power level is required to reach an acceptable temperature more quickly. Then, as an acceptable operating temperature is achieved, the power level is reduced to a maintenance power level Pm.

If a signal is not received from activation device 12 during time duration T, power delivery to device 8 is halted. However, if a signal is received, then the time duration is extended while a maintenance level of power Pm is maintained (indicated by dashed arrow 81). Of course, power versus time curve 74 is simplified for illustrative purposes, the optimal power versus time curve is likely to have more complexity. Also, when a heater is implemented (8*b*), closed loop temperature control via a thermocouple or monitoring resistance may be advantageous.

Figure 9:
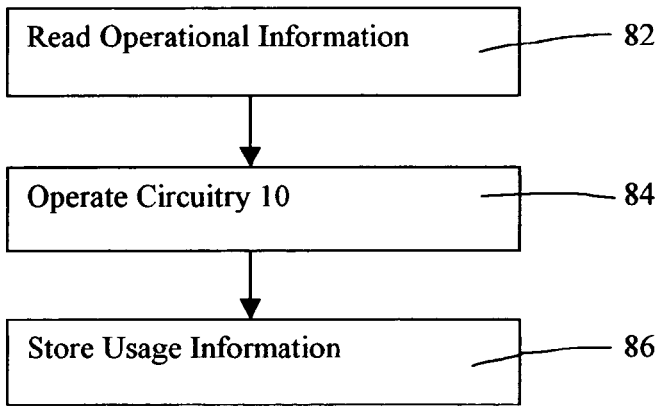
FIG. 9 is an operational flow chart representation for the shaving system.

An exemplary embodiment for the operation of circuitry 10 is depicted with respect to FIG. 9. During initialization of circuitry 10, controller 52 reads information indicative of the operating parameters for circuitry 10 according to step 82. These operating parameters may define a time variation of the power level of the power signals transferred from the circuitry 10 to the energy-imparting device 8. Stated another way, the operation parameters define power versus time characteristics for the power signals received by energy-imparting device 8. Examples of such characteristics may includes a peak power level, a maintenance power level, a total duration of time to apply power, etc., referring to the power transferred between circuitry 10 and energy-imparting device 8. Another parameter may include a time for extending power delivery from circuitry 10 to energy imparting device 8 in the event that a signal from activation device 12 is received during operation of energy-imparting device 8.

Next, according to 84, the circuitry 10 is operated. During step 84, control signals are sent from controller 52 to the motor drive circuit 56 and/or the heater drive circuit 58. Also during step 84, motor drive circuit 56 provides power signals motor (with eccentric weight) 8*a* and/or heater drive circuit 58 provides power signals to the heater element 8*b*.

Finally, after or during operation, usage information is stored according to 86. This usage information may include when the shaving operation took place, the number of activations detected for activation device 12, and the total time power has been applied to energy imparting device 8. Optionally a status of an energy level (power remaining or expected remaining lifetime) of power source 14 can be communicated to the user via the communication device 51.

As stated earlier, one exemplary embodiment of the shaving system 2 or shaving implement 2 of the present invention includes an activation device 12 that imparts a signal in response to handling of the shaving implement 2 during the wet shaving process. Handling of the shaving implement 2 in this context does not include pressing a user-activated switch such as switch 18, but includes either motion or forces experienced by the shaving implement 2 during the shaving process. The shaving process is defined as picking up and/or holding the shaving implement 2 with the handle 6 and then manipulating the handle 6 to draw surface 16 of the blade assembly 4 against a skin surface. The activation device of element 12 is responsive to the above-defined shaving process.

As a first example the activation device 12 can be responsive to the motion and/or acceleration experienced by the shaving implement 2 during the shaving process and can include an accelerometer. As a second example the activation device 12 or 12' can be responsive to motion or translation during the shaving process—in the second example the activation device 12' may include an optical sensor 12' (to be further discussed) for generating a signal indicative of the translation of the blade assembly 4 relative to a skin surface. As a third example, the activation device 12 can be responsive to a force between blade assembly 4 and a skin surface. This third example has been discussed with respect to FIGS. 3A, 3B and 4 for example.

The shaving implement 2 may also include an activation device 18 or switch 18 that is not responsive to the shaving process motions or force and as such may be a button 18 on the side of handle 6. In yet another embodiment the shaving system includes two types of activation devices—(1) a first activation device 18 that is a user activated switch 18 and (2) a second activation device 12 that is responsive to handling of the shaving implement 2 during a shaving process. In yet another embodiment, the shaving system 2 includes three activation devices—(1) a user activated switch 18, (2) a second activation device 12 that is not a user activated switch 18 but that imparts a signal in response to handling of the shaving implement 2, and (3) a third activation device 12' that is a sensor 12' that generates a signal indicative of relative motion or proximity between the blade assembly 4 and a skin surface. Yet other embodiments can include subsets of the above and/or additional activation devices that impart signals utilized by the circuitry 10.

Figure 10:
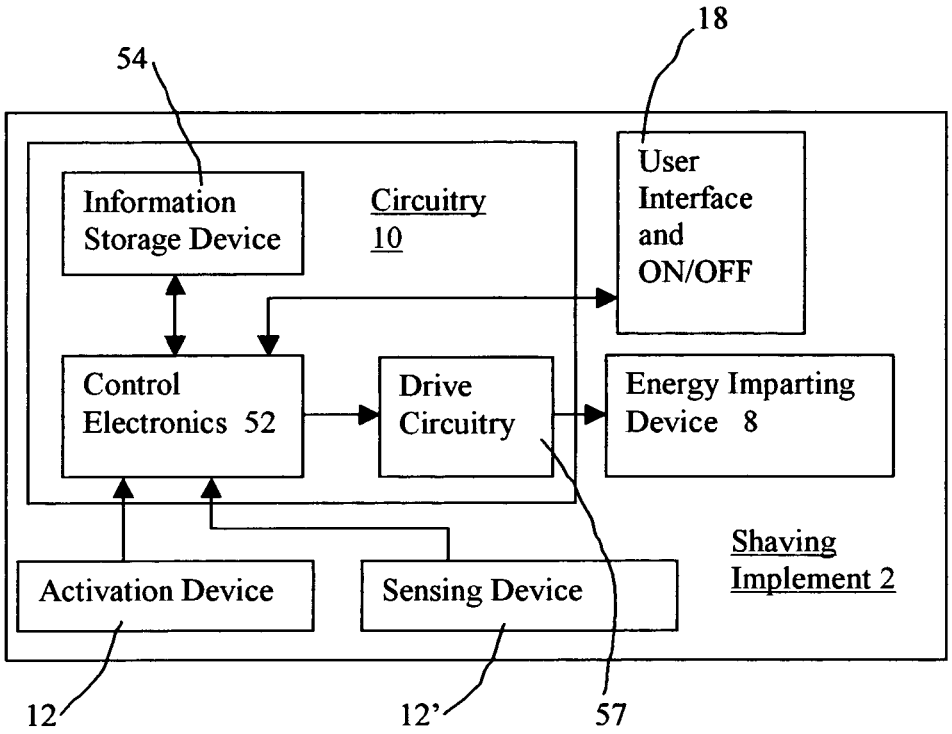
FIG. 10 is a block diagram depiction of an embodiment of the shaving implement of the present invention.

FIG. 10 is a block diagram that depicts another embodiment of the shaving system 2 of the present invention. Shaving system or shaving implement 2 includes circuitry 10 that is coupled to an activation device 12 (that is responsive to handing of the shaving implement 2 during a wet-shaving process), a user interface and/or ON/OFF switch 18, an energy imparting device 8, and a sensing device 12'. The circuitry 10 includes control electronics 52 (e.g., a microprocessor and associated electronics) that are coupled to an information storage device 54 and drive circuitry 57.

During operation the user activates the ON/OFF switch 18. Receiving a signal from switch 18, the controller 52 activates circuitry 10. Controller 52 receives signals from activation circuitry 12 and/or sensing device 12' and in response reads information from information storage device 54 indicative of a power profile to be applied to energy imparting device 8. The control electronics 52 imparts signals or instructions to drive circuitry 57 which in turn provide power signals to energy imparting device 8.

Sensing device or sensor 12' may be utilized in place of or in addition to activation device 12. Sensing device 12' is configured to sense a proximity or relative motion between blade assembly 4 (see earlier figures) and a skin surface. In one embodiment the control electronics 52 are configured to adjust an average power level delivered to energy imparting device 8 in response to an aspect of a signal received by control electronics 52 from sensor 12'.

In one embodiment, element 18 may include a display such as an LCD display that enables a user of shaving system 2 to view a status or state of shaving system 2 or to receive instructions for use of shaving system 2.

Figure 11:
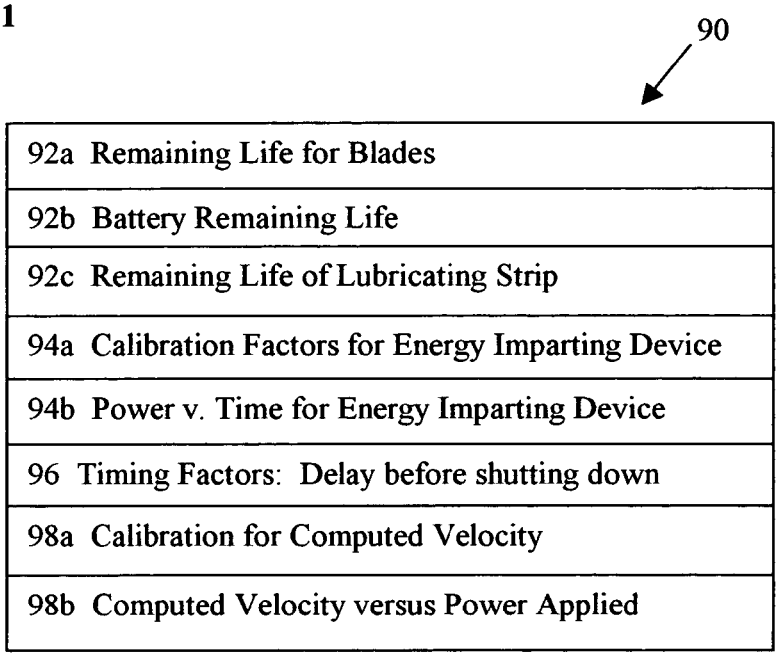
FIG. 11 depicts exemplary information or data elements to be stored on an information storage device of the present invention.

FIG. 11 depicts some data elements 90 or information elements 90 that are stored or encoded onto information storage device 54 during manufacture of shaving system 2 and/or during operation of shaving system 2. These data elements 90 are utilized by control electronics 52 to adjust operation of shaving system 2 or to provide information to a user of shaving system 2 by way of the user interface 18. The set of data elements 90 may include a subset, a superset, or all of the data elements depicted with respect to FIG. 11.

Data elements 92*a-c* are indicative of the initial and/or remaining useful "life" for various components of shaving system 2, including the remaining blade life 92*a*, the remaining battery life 92*b*, and the remaining lubricating strip life 92*c*. The system 2 can inform the user of the shaving system 2 as to a remaining life of the various components by way of the user interface 18 which may include a display device such as an LCD display. Data elements 92*a-c* may be initially stored on memory device 54 during manufacture of shaving system 2 but may also be updated during usage of shaving system 2.

Data elements 94*a* and 94*b* are data elements related to a power versus time to be applied or delivered to the energy-imparting device 8. Data element 94*a* is a calibration factor for the energy-imparting device 8. Control electronics 52 use this information to determine a proper power level to apply to energy-imparting device 8. Having calibration factor 94*a* may be important when characteristics of device 8 are subject to manufacturing variation. Data element 94*b* defines a power versus time that is to be delivered by drive circuitry 57 to energy imparting device 8. Over time better power curves may be determined that enhance effectiveness of energy imparting device 8 and this allows the power profile to be easily improved or updated.

Data element 96 includes timing factors to be used by a timer function in circuitry 10. For example, data element 96 may be utilized by control electronics 52 to determine how long to delay shutting circuitry down when no signal has been imparted by activation device 12 (or sensor 12') that would be indicative of handling the shaving implement 2.

Data elements 98*a* and 98*b* concern the use of sensor 12' in governing the power delivered to energy imparting device(s) 8. While the shaving implement is being used, the controller 52 can utilize parameters 98*a* and 98*b* to adjust the average power output to the energy-imparting device 8 based on a computed relative velocity of the blade assembly 4 relative to a skin surface for example.

Figure 12:
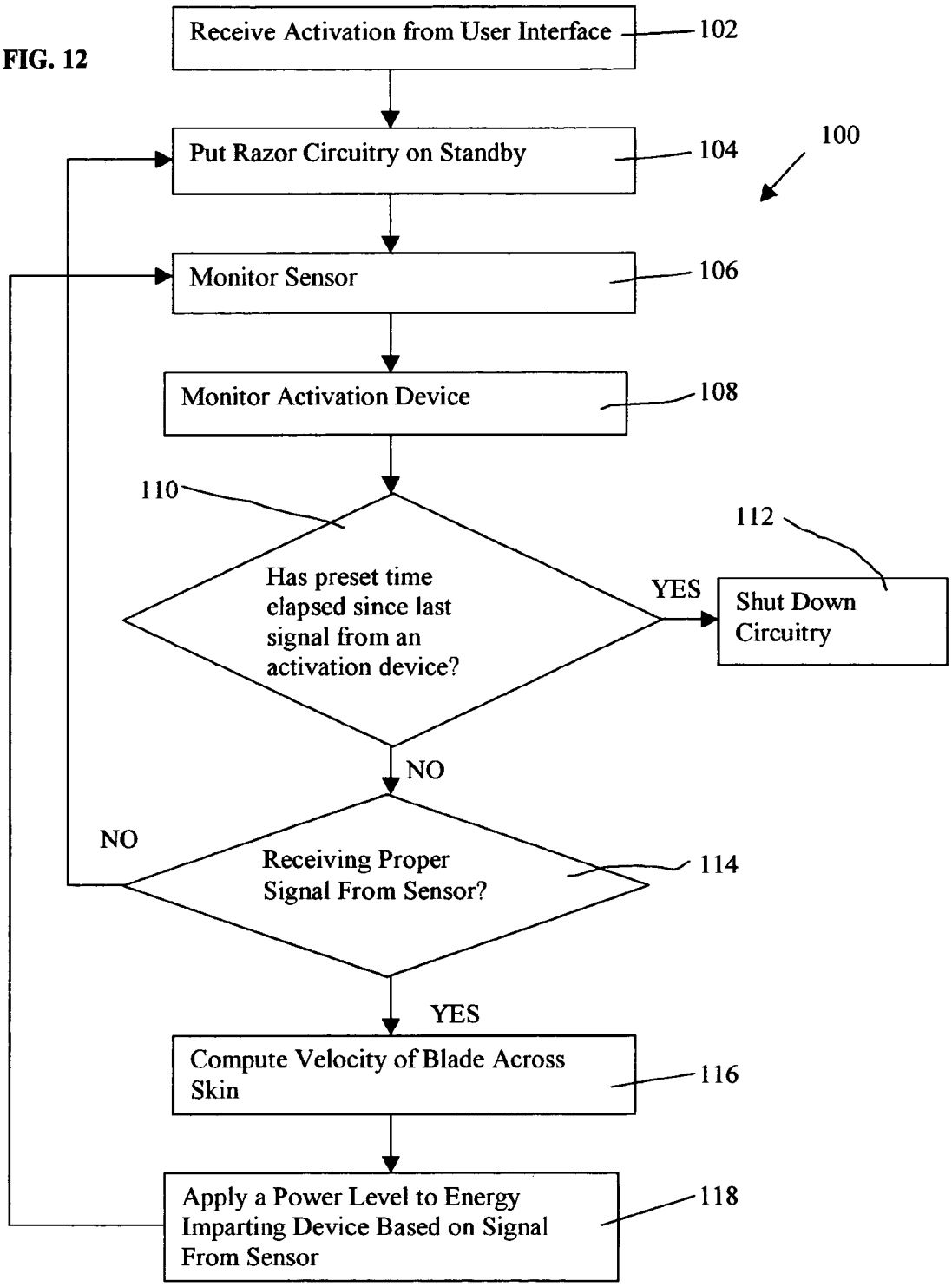
FIG. 12 is a flow chart representation of an exemplary operation of the system depicted in FIG. 10.

FIG. 12 is a flow chart depiction of an exemplary operation of shaving implement 2. According to 102, controller 52 receives an activation signal from user interface or ON/OFF switch 18. In response, the controller 52 places circuitry 10 on "standby" according to 104. On standby, the circuitry monitors sensor 12' according to 106 and activation device 12 according to 108.

According to 110, a decision is made based on whether a time period has elapsed since the last signal from activation device 12. If the time period has elapsed, then circuitry 10 is "shut down" or deactivated according to 112. If the time period has not elapsed, then the circuitry remains on standby and another decision is made according to 114 according to whether a proper signal is being received from sensor 12'. If a proper signal is not being received, then circuitry 10 remains on standby and the process loops back to step 104.

If a proper signal is being received, then circuitry 10 derives a value indicative of a relative velocity between blade assembly 4 and a skin surface according to 116. According to 118, the drive circuitry 57 applies a power level to energy imparting device 8 that is adjusted pursuant to the relative velocity. At that point, the process loops back to 106.

Note that aspects of this process can be present without all of them. Also, functions can be combined. For example, sensor 12' can be utilized to provide the function of sensor 12.

Figure 13A:
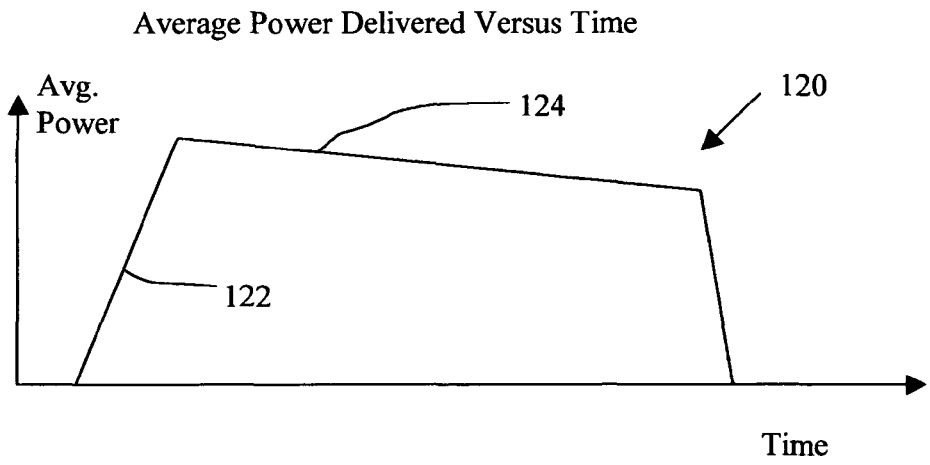
FIGS. 13A and 13B are graphical depictions of exemplary power profiles delivered by drive circuitry to the energy-imparting device.
Figure 13B:
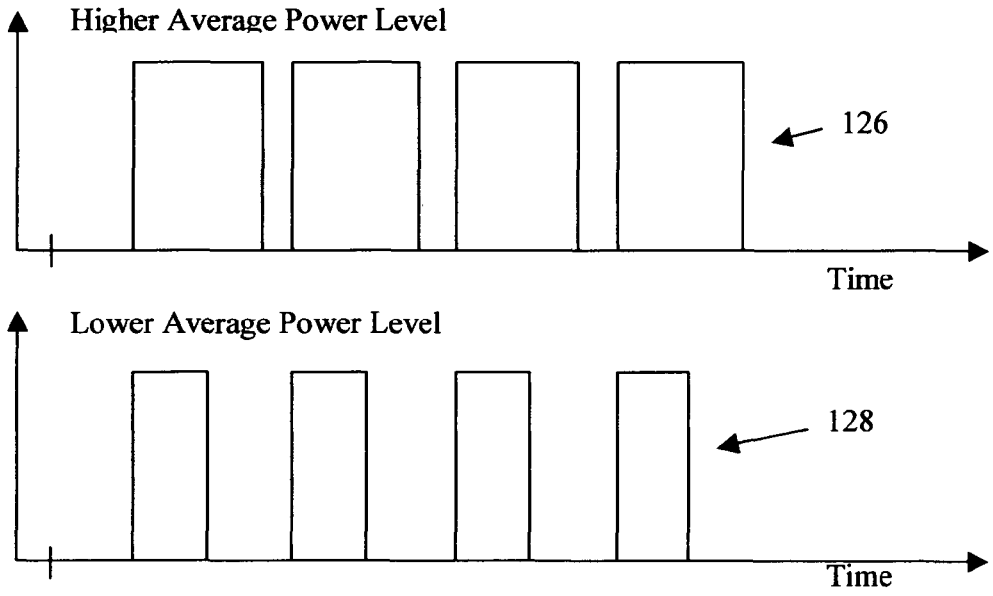

FIGS. 13A and 13B indicate alternative power profiles to be applied by drive circuitry 57 to energy imparting device 8. FIG. 13A is indicative of a power profile 120 that includes a rapid initial ramp 122 (to start up the energy imparting device) and a gradual decline 124 as shaving implement is being utilized. The magnitude of the power delivered (the height of any point on curve 120) is determined by information from sensor 12'. If the sensor is indicative of a higher relative velocity between blade assembly 4 and a skin surface, then the height of the power profile 120 will be larger in magnitude.

FIG. 13B indicates two power profiles utilizing pulse width modulation. For example consider the case wherein the energy imparting device 8 is a light-emitting device (LED) utilized to enhance a shaving process. The average power delivered to the LED is a function of an "on" time of the LED as depicted. If the sensor 12' generates a signal indicative of a higher relative velocity between blade assembly 4 and the skin surface, then a higher average power (greater percentage of time with the LED on) is selected by controller 52 according to 126. On the other hand, if the sensor 12' generates a signal indicative of a lower relative velocity between blade assembly 4 and the skin surface, then a lower average power (smaller percentage of time with the LED on) is selected by controller 52 according to 128.

Figure 14A:
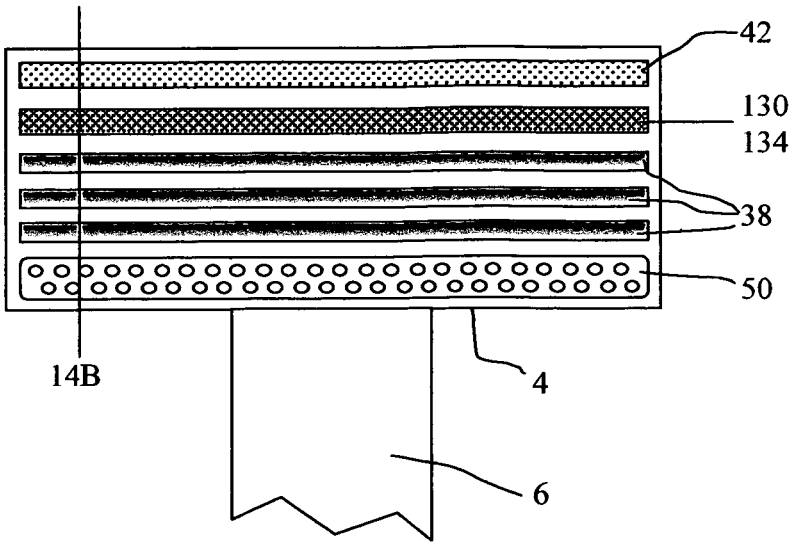
FIGS. 14A and 14B depict face and cross sectional views of a shaving implement of the present invention.
Figure 14B:
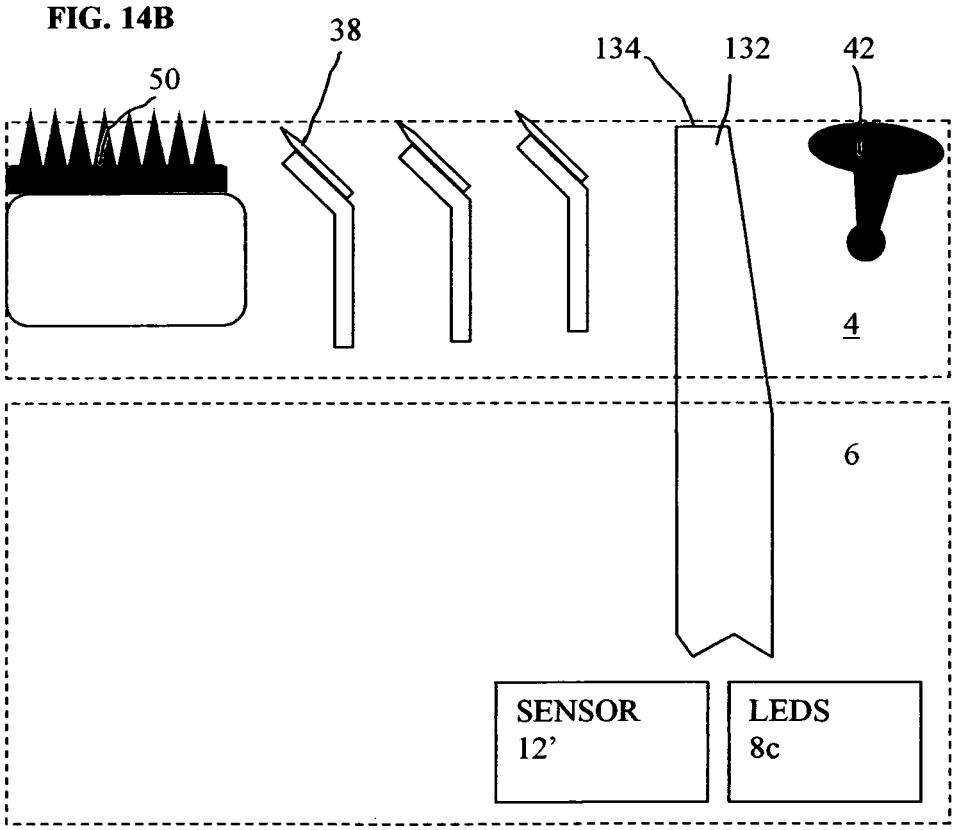

FIGS. 14A and 14B are face (cutting surface 16 from FIG. 1B) and cross sectional views, respectively, of an embodiment of shaving implement 2. Face 16, depicted in 14A includes lubricating strip 42, elastomeric fin structure 50, blades 38, and an energy-transferring portion 130. In one embodiment, the energy-transferring portion 130 includes a columnar arrangement of LEDS (light-emitting devices or diodes). In another embodiment, the energy-transferring portion 130 includes an optical sensor for receiving optical energy. In another embodiment, the energy-transferring portion 130 includes a light pipe 132 for transferring energy to and/or from the skin surface. In yet additional embodiments, energy-transferring portion 130 is configured to transfer vibrational, mechanical, or thermal energy to a surface 134 of energy transferring portion 130. Surface 134 is a generally elongate surface that is parallel to axis A depicted with respect to FIG. 5A.

FIG. 14B is a cross section taken through blade assembly 4 as indicated by 14B-14B in FIG. 14A and is one particular cross-sectional embodiment of FIG. 14A. Depicted in cross sectional form are lubricating strip 42, elastomeric fin structure 50, and blade 38, similar to earlier FIG. 5C. Also depicted is light pipe 132 that couples a sensor 12' and/or LEDS 8*c* to an elongate portion (indicated by 134 in FIGS. 14A and 14B) of the face 16 of blade assembly 4. In a first embodiment, the light pipe 132 is optically coupled to an LED 8*c* (or an array of LEDS 8*c*) to allow optical or infrared or thermal energy to be imparted by the face 134 of light pipe 132 to a skin surface (not shown).

In a second embodiment, light pipe 132 is optically coupled to an optical sensor 12' to allow light entering surface 134 to be imparted to optical sensor 12'. Optical sensor 12' may receive light from a skin surface or it may receive ambient light. An absence of ambient light can be inferred to be indicative of proper contact between face 16 and a skin surface.

In a third embodiment, element 8*c* is replaced by a source of vibrations 8*a*. In this third embodiment, element 132 is a device configured to transfer vibrational energy from 8*a* to elongate surface 134. In a fourth embodiment, element 8*c* is replaced by a source of heat 8*b*. In this fourth embodiment, element 132 is a heat pipe configured to transfer heat from 8*b* to elongate surface 134.

In one embodiment, the blade assembly 4 is replaceable. Upon mounting blade assembly 4 onto handle 6, energy transfer device 132 extends into blade assembly 4 to allow energy transfer to occur from energy imparting device 8 (8*a*, 8*b*, and/or 8*c*) to surface 134 and/or to allow light to pass from surface 134 to sensor 12'.

With the use of one or more energy-imparting devices 8, the shaving system or razor assembly 2 of the present invention provides enhanced shaving such as closer shaves and additional comfort. At the same time, operation of the energy-imparting device is carried out in an optimal way without unnecessary user difficulty or intervention. While some specific embodiments have been described, variations are within the scope of the invention.

What is claimed is:

1. A shaving implement comprising:

a blade assembly including at least one blade configured for direct contact with a skin surface without an intervening micro-screen, the blade assembly configured for a wet shaving process in which a primary cutting motion of the blade assembly is derived when the at least one blade is drawn across the skin surface using a handle portion configured to couple to the blade assembly;

an energy-imparting device configured to impart energy;

an activation device configured to impart a signal;

circuitry, within the handle portion, including a controller coupled to an information storage device storing operational information indicative of operating parameters pertaining to power signals, the stored operating parameters define at least one of a magnitude of a power level delivered from the circuitry to the energy-imparting device, a duration during which the circuitry imparts power signals to the energy-imparting device, and a time variation of the power level of power signals transferred from the circuitry to the energy-imparting device, the controller configured to read the operational information from the information storage device in response to receiving the signal from the activation device, and the circuitry configured to transfer the power signals to the energy-imparting device according to the read operational information to cause the energy-imparting device to impart energy to provide at least one of vibrations and heat to enhance the wet shaving process according to the read operational information.

2. The shaving implement of claim 1, wherein the activation device imparts the signal in response to either forces on the shaving implement, displacement of the blade assembly relative to a handle, or acceleration of the shaving implement during the wet shaving process.

3. The shaving implement of claim 1 wherein the activation device is configured to be activated by the user such as by pressing a switch.

4. The shaving implement of claim 1 wherein the activation device is an optical sensor configured to sense a relative motion between the blade assembly and a skin surface and wherein the circuitry is configured to adjust the power signals in response to a signal received from the sensor.

5. The shaving implement according to claim 1 wherein the stored operating parameters define at least a magnitude of a power level delivered from the circuitry to the energy-imparting device.

6. The shaving implement according to claim 1 wherein the stored operating parameters define a duration during which the circuitry imparts power signals to the energy-imparting device.

7. The shaving implement according to claim 1 wherein the stored operating parameters define at least a time variation of the power level of power signals transferred from the circuitry to the energy-imparting device.

8. A shaving implement comprising:

a blade assembly including at least one blade configured for direct contact with a skin surface without an intervening micro-screen, the blade assembly configured for a wet shaving process in which a primary cutting motion of the blade assembly is derived when the at least one blade is drawn across the skin surface using a handle portion configured to couple to the blade assembly;

an energy-imparting device configured to impart energy;

an activation device configured to be activated by the user;

circuitry, within the handle portion, including a controller and an information storage device storing operational information indicative of operating parameters pertaining to power signals, the stored operating parameters define at least one of a magnitude of a power level delivered from the circuitry to the energy-imparting device, a duration during which the circuitry imparts power signals to the energy-imparting device, and a time variation of the power level of power signals transferred from the circuitry to the energy-imparting device, the controller configured to read the operational information from the information storage device including time duration information indicative of a time period, the circuitry configured to transfer the power signals based on the read operational information to activate the energy-imparting device for the time period that begins in response to receiving an activation signal from the activation device and to cease transferring the power signals to the energy-imparting device automatically when the time period has ended to cause the energy-imparting device to impart energy to provide at least one of vibrations and heat to enhance the wet shaving process according to the read operational information.

9. The shaving implement of claim 8 wherein the activation device is configured to generate the activation signal in response to handling the shaving implement during the wet shaving process.

10. The shaving implement of claim 8 wherein the activation device is configured to generate the activation signal in response to a user pressing a switch.

11. A shaving implement comprising:

an activation device configured to be actuated by the user at the beginning of a wet shaving process;

a blade assembly including at least one blade configured for direct contact with a skin surface without an intervening micro-screen, the blade assembly configured for a wet shaving process in which a primary cutting motion of the blade assembly is derived when the at least one blade is drawn across the skin surface using a handle portion configured to couple to the blade assembly;

an energy-imparting device configured to impart energy; and circuitry, within the handle portion, including a controller and an information storage device storing operational information indicative of operating parameters pertaining to power signals, the stored operating parameters define at least one of a magnitude of a power level delivered from the circuitry to the energy-imparting device, a duration during which the circuitry imparts power signals to the energy-imparting device, and a time variation of the power level of power signals transferred from the circuitry to the energy-imparting device, the controller configured to read the operational information from the information storage device, the circuitry configured to impart the power signals to the energy imparting device based on the read operational information to cause the energy-imparting device to impart energy to provide at least one of vibrations and heat to enhance the wet shaving process according to the read operational information, wherein the circuitry includes a timer function for controlling a time duration during which the power signals are transferred from the circuitry to the energy-imparting device, the circuitry configured to activate the timer function and to begin imparting the power signals in response to the activation device being actuated by the user and to cease imparting the power signals after the time duration without requiring further actuation of the activation device.

12. The shaving implement of claim 11 further comprising an activation device that is configured to generate the activation signal in response to handling of the shaving implement during a wet shaving process.

13. The shaving implement of claim 11 wherein the activation device is a user-activated switch configured to be pressed by a user of the shaving implement.

14. The shaving implement according to claim 11 wherein the stored operating parameters define at least the time duration controlled by the timer function.

15. The shaving implement according to claim 11 wherein the stored operating parameters define at least a magnitude of a power level delivered from the circuitry to the energy-imparting device.

* * * * *